US005816077A

United States Patent [19]

Lee

[11] Patent Number: 5,816,077

[45] Date of Patent: Oct. 6, 1998

[54] WASHING MACHINE

[75] Inventor: Jae-Yoll Lee, Kyungki-Do, Rep. of Korea

[73] Assignee: Daewoo Electronics Co., Ltd., Rep. of Korea

[21] Appl. No.: 807,948

[22] Filed: Feb. 28, 1997

[30] Foreign Application Priority Data

Feb. 29, 1996 [KR] Rep. of Korea ..... 96-3521

[51] Int. Cl.[6] ..... D06F 17/10

[52] U.S. Cl. ..... 68/134

[58] Field of Search ..... 68/133, 134

[56] References Cited

U.S. PATENT DOCUMENTS

| | | | |
|---|---|---|---|
| 118,074 | 8/1871 | Vandenburg | 68/134 |
| 2,148,987 | 3/1939 | Altorfer | 68/134 X |
| 2,718,775 | 9/1955 | Stephens | 68/134 |
| 4,193,275 | 3/1980 | Bochan | 68/134 |
| 4,545,220 | 10/1985 | Ishida | 68/133 |

FOREIGN PATENT DOCUMENTS

| | | | |
|---|---|---|---|
| 514284 | 10/1952 | Belgium | 68/134 |
| 136688 | 5/1989 | Japan | 68/134 |
| 561015 | 5/1944 | United Kingdom | 68/133 |

*Primary Examiner*—Philip R. Coe

*Attorney, Agent, or Firm*—Cushman Darby & Cushman Intellectual Property Group of Pillsbury Madison & Sutro, LLP

[57] ABSTRACT

A washing machine including an improved pulsator which generates highly turbulent water flow within the washing tub so as to enhance the washing capability of the machine while preventing laundry articles from getting tangled is disclosed. The washing machine according to the present invention includes a pulsator comprising a base mounted at an upper end of a power transmitting device and rotated by means of the power transmitting device and a plurality of vanes integrated with the base for generating a turbulent washing flow. Upper openings of the thruholes formed in one vane are opposite to upper openings of the thruholes formed in another vane adjacent to the one vane, and lower openings of the thruholes formed in the one vane are opposite to a lower openings of the thruholes formed in another vane adjacent to the one vane.

4 Claims, 3 Drawing Sheets

WASHING MACHINE

BACKGROUND OF THE INVENTION

1. Field of the Invention

The present invention relates to a washing machine, more particularly to an improved pulsator of a washing machine which generates a highly turbulent water flow within a washing tub to enhance a washing capability of the machine while preventing laundry articles from getting tangled.

2. Description of the Prior Art

In general, there are two categories of washing machines which are in practical use for the purpose of washing laundry articles such as clothes. A first category involves a vortex-type washing machine wherein laundry articles are subjected to a washing action as a pulsator therein rotates to generate a vortex flow within a washing tub. The vortex-type washing machine washes laundry articles in such a manner that vortex flow established by a pulsator applies an impact to the laundry articles so that the laundry articles are rubbed against each other. A second category involves a drum-type washing machine having a horizontal rotary drum partially submerged in the washing water. With this type of washing machine, the laundry articles contained in the rotary drum are rubbed against each other as the drum rotates about its horizontal axis.

These washing machines according to prior art have proven to be poor in their overall cleaning efficiency, mainly because they are not able to dissolve the detergent efficiently, nor can they apply a sufficient intensity of physical force to the laundry articles. Although it may be possible for the vortex-type washing machine to enhance its cleaning efficiency by way of further increasing the rotational speed of the pulsator and thereby creating a more intensive vortex in the washing machine, this would give rise to other disadvantages that the laundry articles tend to be severely damage and to get tangled with each other by the intense vortex flow as the washing operation continues.

With a view to removing the deficiencies encountered by these washing machines, there have been proposed a variety of washing machines that make use of an improved pulsator.

U.S. Pat. No. 4,545,220 (issued to Katsuyuki Ishida et al. on Oct. 8, 1985) discloses a washing machine comprising a pulsator improved to create not only a vortex flow, but also an intense turbulent flow.

FIG. 1 is a longitudinal sectional view of a washing machine comprising a pulsator according to Ishida's Patent. In Ishida's Patent, the washing machine 50 includes casing 1; a tub 3 defining an interior area for holding a liquid therein; a pulsator rotatably mounted relative to the tub 3 and disposed in the interior area thereof, the pulsator including a skirt area 5 having a raised central portion extending to a predetermined upper limit and defining a central axis of rotation, a plural vane 7 radially extending from the upper limit to the periphery of the skirt 5 to establish vortex flow within the liquid, and a member 9 fixed to the skirt 5 for enhancing the agitation of the liquid in the tub 3, the agitation enhancing member 9 defining a second axis parallel to and separated from the central axis and being upwardly extended beyond the uppermost limit of the central portion; and a drive member 13 connected to the pulsator 11 for rotating the pulsator 11 in predetermined forward and reverse cycles about the central axis.

In the washing machine according to Ishida's Patent as constructed above, the agitation enhancing member 9 rotates in a satellite fashion about the central axis upon rotation of the pulsator by means of the drive means to establish localized areas of highly turbulent flow within the vortex flow so that fabric articles will be randomly and turbulently manipulated when encountering the turbulent flow, wherein the agitation enhancing member 9 creates a force generally opposite in direction to that of the vortex flow in the upper region of the tub 3 when the agitation enhancing member 9 comes into contact with the fabric articles in order to facilitate the cleansing thereof.

In the washing machine according to Ishida's Patent, however, there are problems in that the pulsator generally is increased in size and the fabric articles are concentrate and get tangled with each other at a side within the tub due to the rod-shaped projection upwardly extending from the skirt of the pulsator.

SUMMARY OF THE INVENTION

The present invention has been made to overcome the above described problem of the prior art. It is an object of the present invention to provide a washing machine comprising a pulsator which generates not only a vortex flow, but also an intense turbulent flow as to enhance the washing capability of the washing machine and to prevent laundry articles from getting tangled.

To accomplish the above object of the present invention, there is provided a washing machine which comprises:

a housing;

an outer tub which is disposed in the housing, for receiving washing water;

a power source which is mounted on a bottom side of the outer tub, for generating a driving force;

a power transmitting device which is disposed at a center portion of the outer tub, for generating a rotation thereof in forward and reverse directions by means of the driving force transmitted from the power source to the power transmitting device;

an inner tub which is disposed in the outer tub, for receiving laundry articles; and a pulsator which is mounted on a bottom portion of the inner tub and in which a central axis thereof is connected to the power transmitting device, for establishing a washing flow in such a manner that the pulsator is rotated in forward and reverse directions by means of the power transmitting device, the pulsator including a base and a plurality of vanes integrated with the base and having a plurality of thruholes formed therein, wherein during washing cycles, the most of the washing water is formed into a vortex-flow by the plurality of vanes and the rest of the washing water is formed into a turbulent flow by the plurality of thruholes formed in each of vanes.

The plurality of thruholes formed in each of vanes are inclined from an upper portion of the vanes to a lower portion of vanes.

The vanes have a first group of vanes and a second group of vanes, upper openings of the thruholes formed in a first vane of the first group are opposite to upper openings of the thruholes formed in a first vane of the second group adjacent to the first vane of the first group, and lower openings of the thruholes formed in the first vane of the first group are opposite to lower openings of the thruholes formed in a second vane of the second group adjacent to the first vane of the first group.

In the washing machine according to the present invention as constructed above, when a user pushes a operation switch installed on a control panel which is disposed on a side of the upper surface of the washing machine, electricity is supplied to the power source, for example an electric motor, of the washing machine. The electric motor generates and transmits driving forces through a belt to a power transmitting device mounted at the central portion of the bottom of the outer tub. At this time, a rotating shaft of the electric motor rotates alternately in forward and reverse directions according to a predetermined cycle. Accordingly, the pulsator connected to a rotating shaft of the power transmitting device also rotates in forward and reverse directions. A vortex flow is generated by the vanes of the pulsator from the most of washing water as the pulsator rotates. Also, a turbulent flow is created within the rest of washing water passing through the plurality of the thruholes formed in the each of vanes. The vortex flow and the turbulent flow generated by the pulsator make impact with the laundry articles so as to enhance the washing capability of the washing machine and to prevent the laundry articles from getting tangled.

BRIEF DESCRIPTION OF THE INVENTION

The above object and other advantages of the present invention will become more apparent by describing in detail the preferred embodiment thereof with reference to the attached drawings, in which.

DESCRIPTION OF THE PREFERRED EMBODIMENT

Hereinafter, a preferred embodiment of the present invention will be described in detail with reference to the accompanying drawings.

Figure 1:
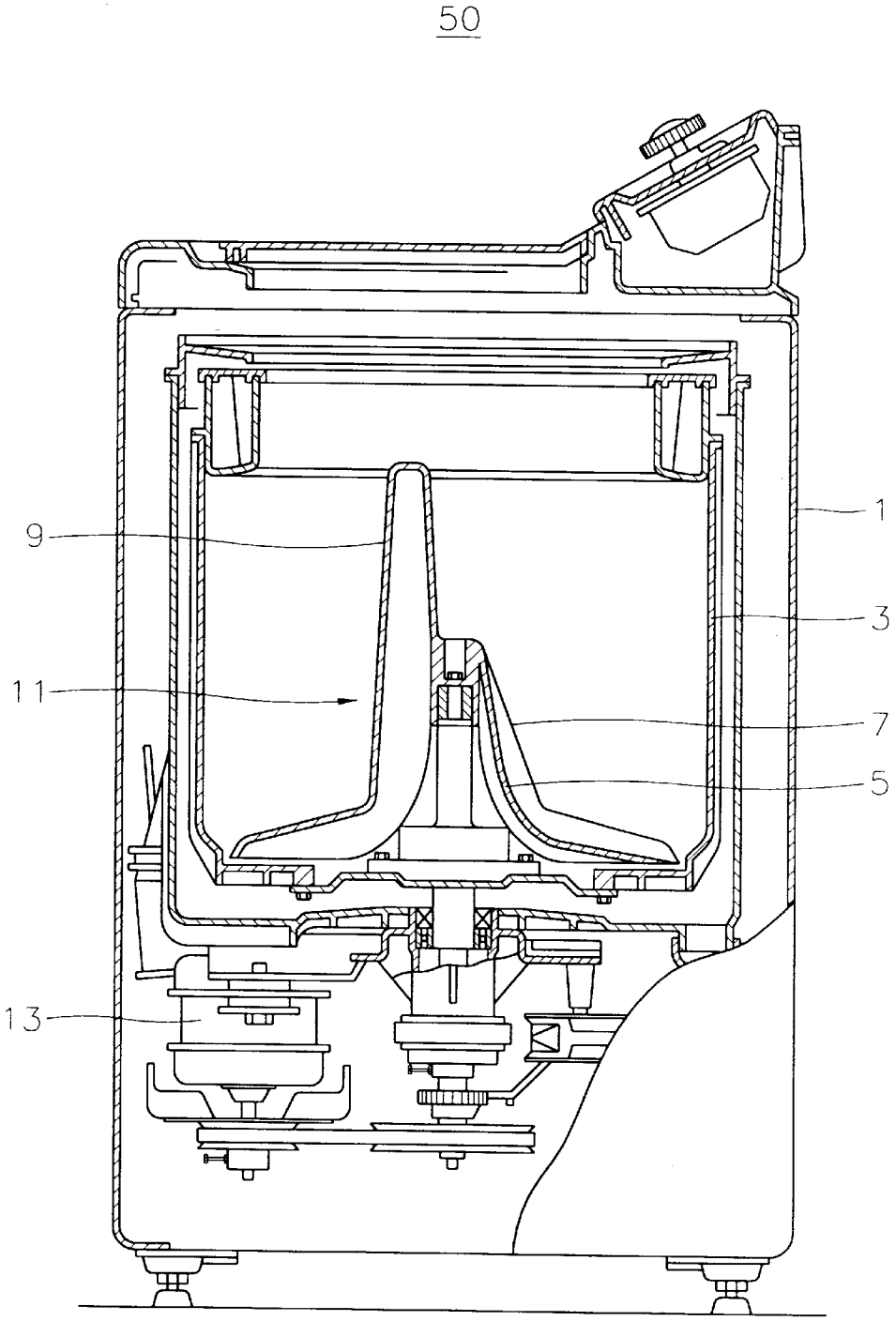
FIG. 1 (PRIOR ART)
FIG. 1 is a cross-sectional elevational view of a washing machine according to the conventional invention.
Figure 2:
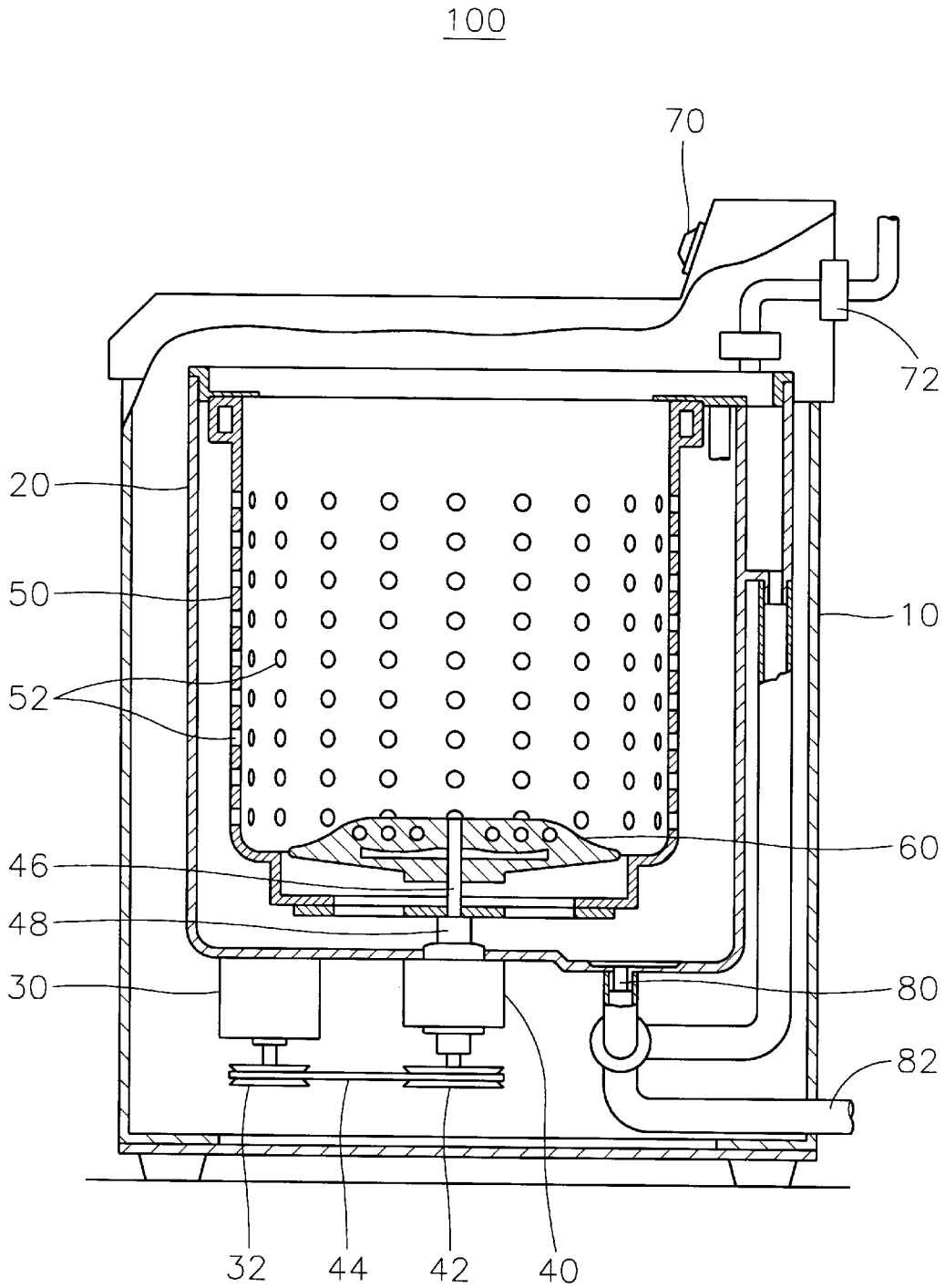
FIG. 2 is a cross-sectional elevational view of a washing machine including a pulsator according to an embodiment of the present invention.

FIG. 2 is a cross-sectional elevational view of a washing machine including a pulsator according to an embodiment of the present invention. In FIG. 2, the washing machine 100 comprises a housing 10; an outer tub 20 disposed in the housing 10, for receiving washing water; a power source 30 mounted on a bottom side of the outer tub 20, for generating a driving force; a power transmitting device 40 disposed at a center portion of the outer tub 20, for generating a rotation thereof in forward and reverse directions by means of the driving force transmitted from the power source 30 to the power transmitting device 40; an inner tub 50 disposed in the outer tub 20, for receiving laundry articles; and a pulsator 60 which is mounted on a bottom portion of the inner tub 50 and in which a central axis thereof is connected to the power transmitting device 40, for establishing a washing flow in such a manner that the pulsator 60 is rotated in forward and reverse directions by means of the power transmitting device 40.

Housing 10 protects outer tub 20, power source 30, and power transmitting device 40 from outer impacts. A control panel 70 is installed on a portion of an upper surface of housing 10 to repeatedly control cycles of water supplying, washing, rinsing, dewatering, and draining. A water supplying port 72 is disposed on a side of control panel 70.

Outer tub 20 has a cylindrical shape and is disposed in housing 10. An upper portion of outer tub 20 is connected to water supplying port 72 disposed on control panel 70. Power source 30 and power transmitting device 40 are arranged on a bottom of outer tub 20. Furthermore, a drain port 80 is formed on an outer surface of the bottom of outer tub 20 and is connected to a drain pipe 82. During the washing, outer tub 20 receives washing water supplied through water supplying port 72, and during the cycles of dewatering and draining, washing water is discharged through drain port 80 out of washing machine.

Power source 30 is arranged on the bottom of outer tub 20, as described above. An electric motor generally is used as power source 30. A rotating shaft of power source 30 is rotated in forward and reverse directions during the cycle of washing and only in one direction during the cycle of dewatering by control signals of micro-computer (not shown) installed within control panel 70. A belt pulley 32 is mounted at one end of the rotating shaft of power source 30 and is connected by a belt 44 to a belt pulley 42 mounted at a driving shaft of power transmitting device 40. Accordingly, a rotation of power transmitting source 30 is transmitted to power transmitting device 40 through belt pulley 32 of power source 30, belt 44, and belt pulley 42 of power transmitting device 40.

Power transmitting device 40 is arranged on the central portion of the bottom of outer tub 20 and includes a first driving shaft 46, a second driving shaft 48, a clutch (not shown), a brake device (not shown), and a casing. First driving shaft 46 extends through the bottom of outer tub 20 and a bottom of inner tub 50, and has belt pulley 42 mounted at the one end thereof. A rotating force is transmitted through belt pulley 42 mounted at first driving shaft 46 of power transmitting device 40 from power source 30 to power transmitting device 40. Second driving shaft 48 of power transmitting device 40 extends through the bottom of outer tub 20, which in turn is connected to the bottom of inner tub 50. The clutch is disposed between first driving shaft 46 and second driving shaft 48 of power transmitting device 40. A spring clutch generally is used as the clutch. The clutch is released by an operation of a control device (not shown) during the washing cycle, while the clutch simultaneously makes contact with first driving shaft 46 and second driving shaft 48 of power transmitting device 40 by an operation of the control device and rotates together with first driving shaft 46 and second driving shaft 48 so that power is transmitted from power source 30 to second driving shaft 48. The brake device includes a brake drum (not shown) and a brake band (not shown). The brake drum comes into contact with second driving shaft 48 at an intermediate portion of second driving shaft 48. The brake band is arranged on the outer peripheral surface of the brake drum. During a washing cycle, the brake band makes contact with the outer peripheral surface of the brake drum by an operation of a control device (not shown) and prevents the brake drum from rotating. Also, during the dewatering cycle, the brake band is released from contact with the brake drum by an operation of the control device so that the brake drum may rotate.

Inner tub 50 is disposed in outer tub 20. Inner tub 50 is connected to second driving shaft 48 of power transmitting device 40, as described above. Inner tub 50 has a cylindrical shape and has a plurality of thruholes 52 formed in a side wall thereof. During the washing of laundry articles, in the dewatering or draining cycle, the washing water within inner tub 50 is discharged through holes 52 to outer tub 20.

Figure 3:
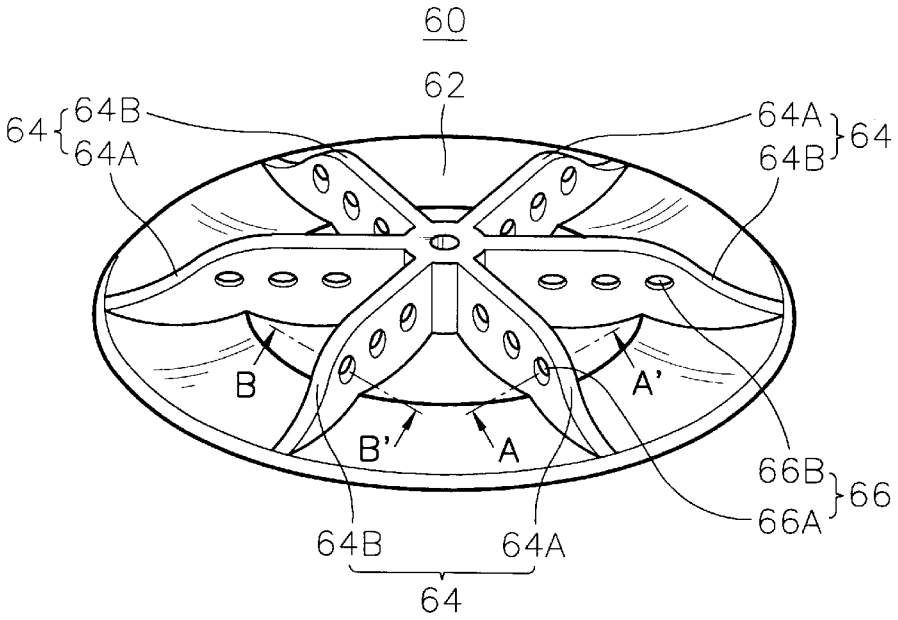
FIG. 3 is a perspective view of the pulsator according to the present invention.
Figure 4:
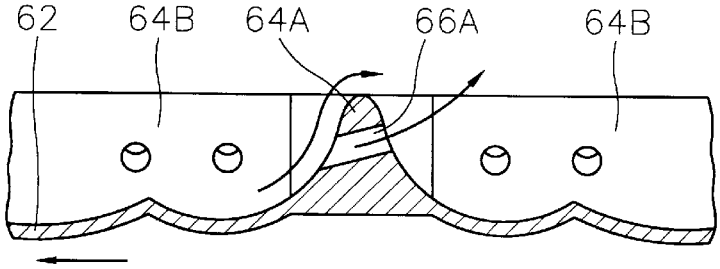
FIG. 4 is a partially sectional view of the pulsator taken along line A–A' in FIG. 3.
Figure 5:
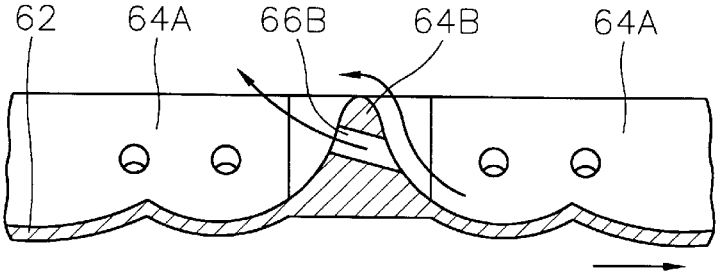
FIG. 5 is a partially sectional view of the pulsator taken along line B–B' in FIG. 3.

Referring to FIGS. 3 to 5, pulsator 60 is arranged on the bottom of inner tub 50, in which a central axis thereof is connected to the other end of first driving shaft 46. Pulsator 60 includes a base 62 and a plurality of vanes 64 integrated with base 62 and having a plurality of thruholes 66 in each of vanes 64. Through holes 66 formed in each of vanes 64 are inclined from an upper portion to a lower portion of vanes 64. On the other hand, vanes 64 have a first group of vanes 64A and a second group of vanes 64B, upper openings of thruholes 66A formed in a first vane of first group vanes 64A are opposite to upper openings of thruholes 66B formed in a first vane of second group vanes 64B adjacent to the first vane of first group vanes 64A, and lower openings of thruholes 66A formed in the first vane of first group vanes 64A are opposite to lower openings of thruholes 66B formed in a second vane of second group vanes 64B adjacent to the first vane of first group vanes 64B.

Hereinafter, the operation of each of the elements of washing machine 100 comprising pulsator 60 according to the present invention described above will be described.

In washing machine 100 according to the present invention, during the washing cycle the rotating shaft of power source 30 rotates in forward and reverse directions in the state that the brake band makes tight contact with the brake drum as to prevent second driving shaft 48 and inner tub 50 connected to second driving shaft 48 from being rotated. At this time, power transmitting device 40, which receives power transmitted from power source 30, only rotates first driving shaft 46 thereof in the same direction as a rotating direction of power source 30. Accordingly, pulsator 60 connected to the other end of first driving shaft 46 also rotates in forward and reverse directions so that most of the washing water received within inner tub 50 is formed into the vortex flow by vanes 64 of pulsator 60 and the rest of the washing water passing through plural thruholes 66 is formed into the turbulent flow. As a result, the laundry articles received within inner tub 50 is prevented from getting tangled with each other and the washing capability of the washing machine 100 is enhanced.

Furthermore, during the dewatering cycle, the rotating shaft of power source 30 rotates in either a forward or a reverse direction in the state that the brake band is released from contact with the brake drum. At the same time, the clutch, which is disposed between first driving shaft 46 and second driving shaft 48, of power transmitting device 40, connects first driving shaft 46 with second driving shaft 48, and first driving shaft 46 and second driving shaft 48 are rotated together by the power transmitted from power source 30. Therefore, pulsator 60 and inner tub 50 simultaneously rotate and can separate the washing water from the laundry articles.

In the washing machine according to the present invention as constructed above, there is an advantage that the vortex flow and the turbulent flow are created by the vanes of pulsator and the plurality of the holes formed in each of the vanes to enhance the washing capability of the washing machine and to prevent the laundry articles from getting tangled.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A washing machine comprising:

a housing;

an outer tub which is disposed in the housing, for receiving washing water;

a power source which is mounted on a bottom side of the outer tub, for generating a driving force;

a power transmitting device which is disposed at a center portion of the outer tub, for generating a rotation thereof in forward and reverse directions by means of the driving force transmitted from the power source to the power transmitting device;

an inner tub which is disposed in the outer tub, for receiving laundry articles; and a pulsator which is mounted on a bottom portion of the inner tub and in which a central axis thereof is connected to the power transmitting device, for generating a vortex-flow in such a manner that the pulsator is rotated in forward and reverse directions by means of the power transmitting device, the pulsator including a base and a plurality of vanes integrated with the base, the vanes including a first group of vanes and a second group of vanes, the vanes of the first and second groups being disposed alternately at the base, the first group of vanes being formed with a plurality of first inclined thruholes, the second group of vanes being formed with a plurality of second inclined thruholes which are inclined oppositely with respect to the first inclined thruholes so that some of the washing water is upwardly introduced through a respective one of the first and second inclined thruholes while the pulsator rotates respectively in forward and reverse directions, wherein during a washing cycle, most of the washing water is formed into the vortex-flow by the plurality of vanes and a rest of the washing water is formed into a turbulent flow by the plurality of thruholes formed in each of the vanes.

2. A washing machine as claimed claim 1, wherein upper portions of the first inclined thruholes formed in each of the first group of vanes face to upper portions of the second inclined thruholes formed in each of the second group of vanes adjacent to each of the first group of vanes, and lower portions of the first inclined thruholes formed in each of the first group of vanes face to lower portions of the second inclined thruholes formed in each of the second group of vanes adjacent to each of the first group of vanes.

3. A pulsator comprising:

a base being rotated in forward and reverse directions by means of a power transmitting device; and a plurality of vanes integrated with the base; the vanes including a first group of vanes and a second group of vanes, the vanes of the first and second groups being disposed alternately at the base, the first group of vanes being formed with a plurality of first inclined thruholes, the second group of vanes being formed with a plurality of second inclined thruholes which are inclined oppositely with respect to the first inclined thruholes, so that some of washing water is upwardly introduced through a respective one of the first and second inclined thruholes while the pulsator rotates respectively in forward and reverse directions for generating a vortex-flow, wherein during a washing cycle, most of washing water is formed into the vortex-flow by the plurality of vanes and a rest of the washing water is formed into a turbulent flow by the plurality of thruholes formed in each of vanes.

4. A pulsator as claimed in claim 3, wherein, upper portions of the first inclined thruholes formed in each of the first group of vanes face to upper portions of the second inclined thruholes formed in each of the second group of vanes adjacent to each of the first group of vanes, and lower portions of the first inclined thruholes formed in each of the first group of vanes face to lower portions of the second inclined thruholes formed in each of the second group of vanes adjacent to each of the first group of vanes.

* * * * *